US008770114B2

(12) United States Patent
Kiskis et al.

(10) Patent No.: US 8,770,114 B2
(45) Date of Patent: Jul. 8, 2014

(54) COLLAPSIBLE DUAL SIDED PRIVACY CARREL

(71) Applicants: Kenneth Michael Kiskis, Springfield, OH (US); Ronald Dean Zerrer, Springfield, OH (US)

(72) Inventors: Kenneth Michael Kiskis, Springfield, OH (US); Ronald Dean Zerrer, Springfield, OH (US)

( * ) Notice: Subject to any disclaimer, the term of this patent is extended or adjusted under 35 U.S.C. 154(b) by 0 days.

(21) Appl. No.: 13/728,826

(22) Filed: Dec. 27, 2012

(65) Prior Publication Data

US 2013/0291768 A1 Nov. 7, 2013

Related U.S. Application Data

(60) Provisional application No. 61/641,647, filed on May 2, 2012.

(51) Int. Cl.
*A47B 96/00* (2006.01)

(52) U.S. Cl.
USPC ..... 108/50.11; 312/196

(58) Field of Classification Search
USPC ..... 108/60, 27, 50.01, 50.02, 28, 50.11; 312/196, 258, 223.3, 140.4; 248/459; 211/126.16, 132.1, 126.6
See application file for complete search history.

(56) References Cited

U.S. PATENT DOCUMENTS

| | | | | | |
|---|---|---|---|---|---|
| 2,035,651 | A * | 3/1936 | Hailparn | 40/539 |
| 2,229,257 | A * | 1/1941 | Reaume | 248/174 |
| 3,382,970 | A * | 5/1968 | Sellors | 206/45.24 |
| 3,389,947 | A * | 6/1968 | Kelley et al. | 312/258 |
| 3,550,540 | A * | 12/1970 | Harris et al. | 108/23 |
| 3,629,960 | A * | 12/1971 | Roush | 434/429 |
| 3,636,890 | A * | 1/1972 | Huff | 108/60 |
| 3,742,642 | A * | 7/1973 | Zegers-Ten Horn | 434/430 |
| 4,384,651 | A * | 5/1983 | Smith | 211/132.1 |
| 4,451,728 | A * | 5/1984 | McKay et al. | 235/50 R |
| 4,484,787 | A * | 11/1984 | Stephens | 312/239 |
| 4,493,424 | A * | 1/1985 | Smith | 211/149 |
| 4,569,564 | A * | 2/1986 | Ahmann | 312/259 |
| 5,877,896 | A * | 3/1999 | Gremban | 359/601 |
| 5,890,782 | A * | 4/1999 | Alberts | 312/196 |
| 6,427,609 | B1 * | 8/2002 | Grant | 108/60 |
| 7,304,839 | B1 * | 12/2007 | Burns | 361/679.55 |
| D560,072 | S * | 1/2008 | Willis et al. | D6/332 |
| 8,181,582 | B2 * | 5/2012 | Abel et al. | 108/91 |
| 2005/0183639 | A1 * | 8/2005 | O'Leary | 108/60 |
| 2006/0279916 | A1 * | 12/2006 | Boudreau | 361/681 |
| 2012/0055379 | A1 * | 3/2012 | Roberts | 108/50.11 |
| 2013/0192106 | A1 * | 8/2013 | Meyer-Hanover et al. | 40/299.01 |

* cited by examiner

*Primary Examiner* — Janet M Wilkens

(57) ABSTRACT

A collapsible dual sided privacy carrel designed to reduce distractibility in academic and work place settings accomplishes this through the use of bilaterally positioned hinged panels and a central section with an open viewing area. The collapsible dual sided privacy carrel securely deploys atop a work surface providing personal privacy partition in various environments. After use the carrel quickly collapses to a compact state allowing for facilitated storage. The collapsible dual sided privacy carrel comprises a central section, a first panel, a second panel, a first hinge, and a second hinge. The first panel and the second panel each comprise a peripheral vision obstruction, a section hinge, and a ground contacting section. The central section comprises a viewing area and a support section. The configuration of these components and subcomponents provides users with a private study carrel that effectively obscures laterally positioned distractions while in use.

8 Claims, 6 Drawing Sheets

COLLAPSIBLE DUAL SIDED PRIVACY CARREL

The current application claims a priority to the U.S. Provisional Patent application Ser. No. 61/641,647 filed on May 2, 2012.

FIELD OF THE INVENTION

The present invention relates generally to a privacy partition, more particularly, a collapsible dual sided partition that sits on a surface and functions as a study carrel. The present invention provides an open front while obscuring distractions from peripheral fields of view.

BACKGROUND OF THE INVENTION

It is generally accepted that work place success is measured by productivity. For many, increased productivity is directly linked with higher wages and a better chance of being selected for promotions. Although it's usually the intent of the worker to reach their highest possible level of productivity, there are several factors that negatively affect their work place success. Of these factors, none is more pervasive than work place distractibility. Work place distractibility is a serious problem that hinders productivity and has been estimated to cost as much as $77 billion in annual revenue loss.

Reducing distractibility is an important factor for improving productivity and success in the classroom. Although, this statement holds true in everyday situations, its significance is most apparent in test taking scenarios. For students, small distractions eat away at their limited time to complete an examination to the best of their ability. With the enumerable amount of examinations that a student must perform throughout their academic career, it behooves the student to take all necessary steps to reduce distractibility.

While many students work hard and study to ensure their academic success, less scrupulous individuals find shortcuts such as cheating. For educators cheating is a serious concern. Cheating devalues the academic integrity of an institution and harms its reputation. As a result, educators have very strict policies set up to prevent and deal with this form of academic misconduct. While strict policies are necessary they are not perfect and have at times resulted undeserved punishment and scorn. For students accused of cheating, the allegations have far reaching repercussion that can potentially destroy their academic and employment opportunities.

It is therefore the object of the present invention to provide an apparatus that reduces distractibility in academic and work place settings through the use of a dual sided partition. The present invention provides users in work place and academic settings with a personal privacy partition. The present invention additionally offers peace of mind to academic instructors by offering a reliable means to prevent most cheating. The present invention functions by deploying atop a work surface such as a desk and obscuring the right and left side peripheral fields of view. The present invention provides an open frontal area that allows for a worker to view their computer in a work place scenario. The apparatus also provides a secure way for students to view instructions and lectures while providing educators the ability to monitor each student's actions in an academic setting.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
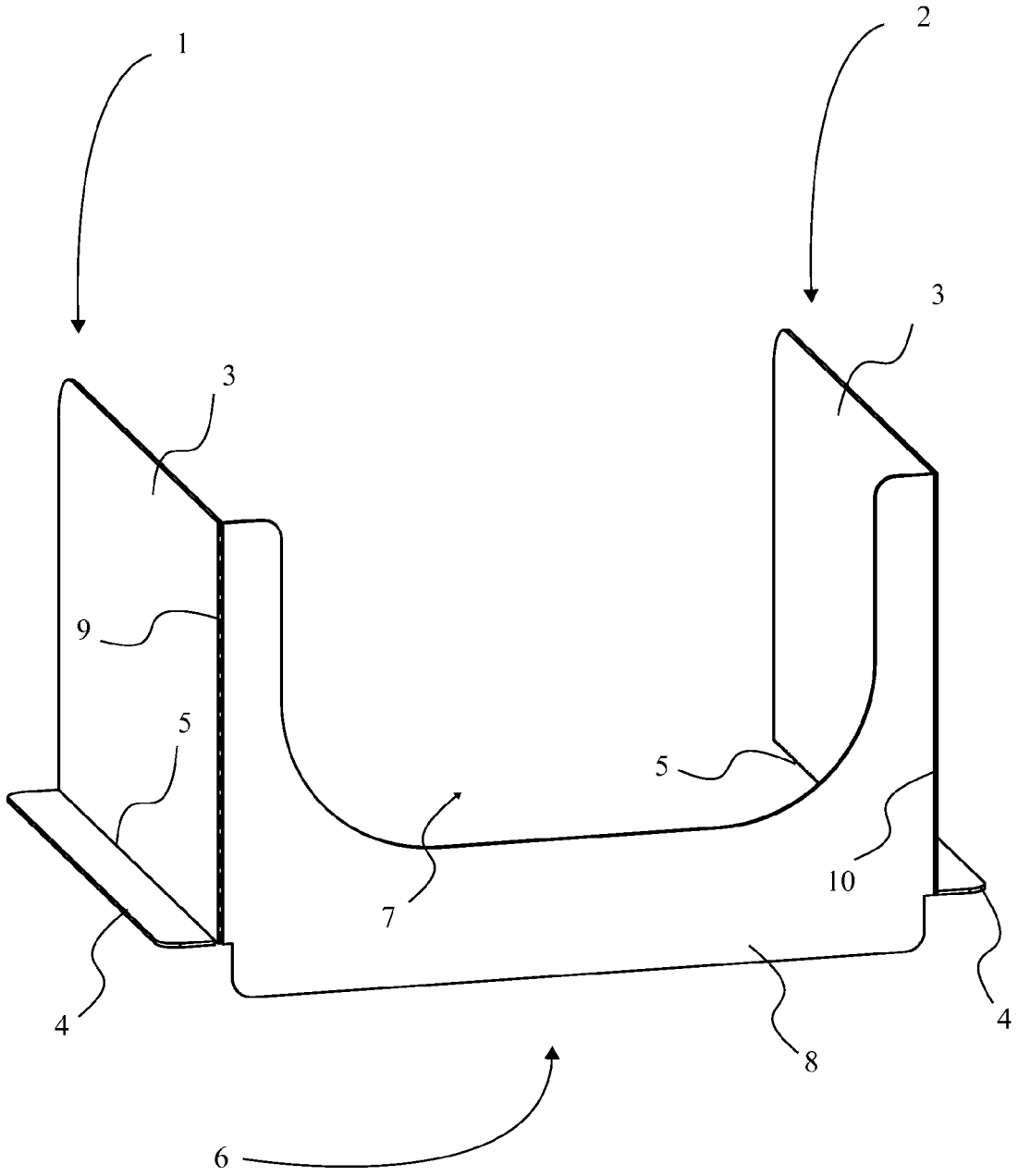
FIG. 1 is a perspective view of the first deployed configuration of the apparatus displaying positioning of the first panel, the second panel, and the central section as per the current embodiment of the present invention.

Referencing FIG. 1, the present invention is an apparatus that functions as a collapsible dual sided privacy carrel which mounts atop a work surface providing a user with a means to obscure laterally positioned distractions from their peripheral fields of view allowing for greater focus on forwardly positioned subject matter. Additionally the present invention provides a collapsible construction which provides a user with a means to conveniently store the apparatus after use. The present invention comprises a first panel 1, a second panel 2, a central section 6, a first hinge 9, and a second hinge 10. The first panel 1 and the second panel 2 provide the present invention with a means to obscure lateral distraction from the user's peripheral field of view. The central section 6 is the centrally located section that provides an open viewing area 7 for forwardly positioned subject matter. The first hinge 9 and the second hinge 10 provide the present invention with a means of facilitated storage by allowing the first panel 1 and the second panel 2 to fold up after use.

Figure 2:
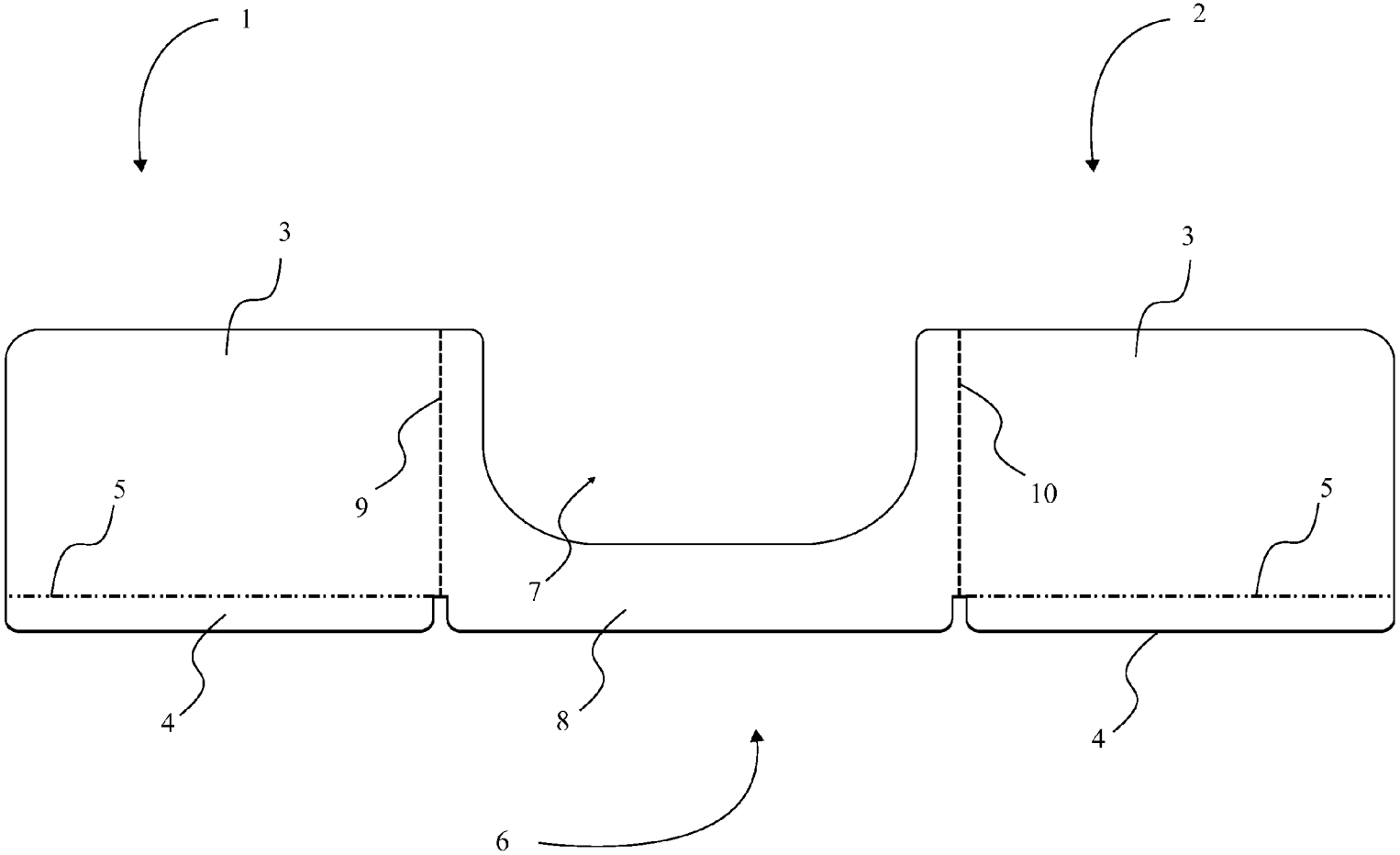
FIG. 2 is a top down elevational view of the expanded planar state of the apparatus displaying the positioning of the various components as per the current embodiment of the present invention.

Referencing FIG. 2, the central section 6 is the centralized portion of the present invention that is positioned between the first hinge 9 and the second hinge 10. The central section 6 is pivotably attached to the first panel 1 by way of the first hinge 9. The central section 6 is pivotably attached to the second panel 2 by way of the second hinge 10. The central section 6 comprises a viewing area 7 and a support section 8. The viewing area 7 is the centrally positioned section that provides an unobstructed view of forwardly positioned subject matter. The viewing area 7 is found positioned above the support section 8 and is laterally bordered by the first panel 1 and the second panel 2. The support section 8 is the lower half of the central section 6 that functions as part of the foundation of the present invention when deployed atop a work surface.

Referencing FIG. 1 and FIG. 2, the first panel 1 and the second panel 2 function as the laterally positioned peripheral vision obstructing partition of the present invention. The first panel 1 is positioned adjacent to the first hinge 9, opposite the central section 6. The second panel 2 is positioned adjacent to the second hinge 10, opposite the central section 6. The first panel 1 is pivotably attached to the central section 6 by way of the first hinge 9. The second panel 2 is pivotably attached to the central section 6 by way of the second hinge 10. The first panel 1 and the second panel 2 each comprise a ground contacting section 4, a peripheral vision obstruction 3, and a section hinge 5. The ground contacting section 4 is the lower portion the first panel 1 and the second panel 2 that functions as part of the foundation of the present invention when deployed atop of a work surface. The section hinge 5 is the axis of rotation between the peripheral vision obstruction 3 and the ground contacting section 4. The ground contacting section 4 is positioned adjacent the section hinge 5 opposite the peripheral vision obstruction 3. The ground contacting section 4 is pivotably attached to the peripheral vision obstruction 3 by way of the section hinge 5. The section hinge 5 functions as a pivoting coupler between the peripheral vision obstruction 3 and the ground contacting section 4. The peripheral vision obstruction 3 is the upper region of the first panel 1 and the second panel 2 that functions as an opaque surface that blocks laterally positioned distractions from a user's peripheral field of view. The peripheral vision obstruction 3 is positioned above the section hinge 5 and the ground contacting feature. The peripheral vision obstruction 3 of the first panel 1 and the peripheral vision obstruction 3 of the second panel 2 laterally border the viewing area 7 of the central section 6.

Referencing FIG. 3-6, the first hinge 9 and the second hinge 10 provide the present invention with the ability to deploy from a collapsed state and return to the collapsed state after use. The first hinge 9 and the second hinge 10 function as a coupling component between the first panel 1 and the central section 6 as well as the second panel 2 and the central section 6, respectively. The first hinge 9 and the second hinge 10 provide an axis of rotation between the first panel 1 and central section 6 as well as the second panel 2 and the central section 6, respectively. The first hinge 9 is positioned between the first panel 1 and the central section 6. The second hinge 10 is positioned between the second panel 2 and the central section 6.

Figure 3:
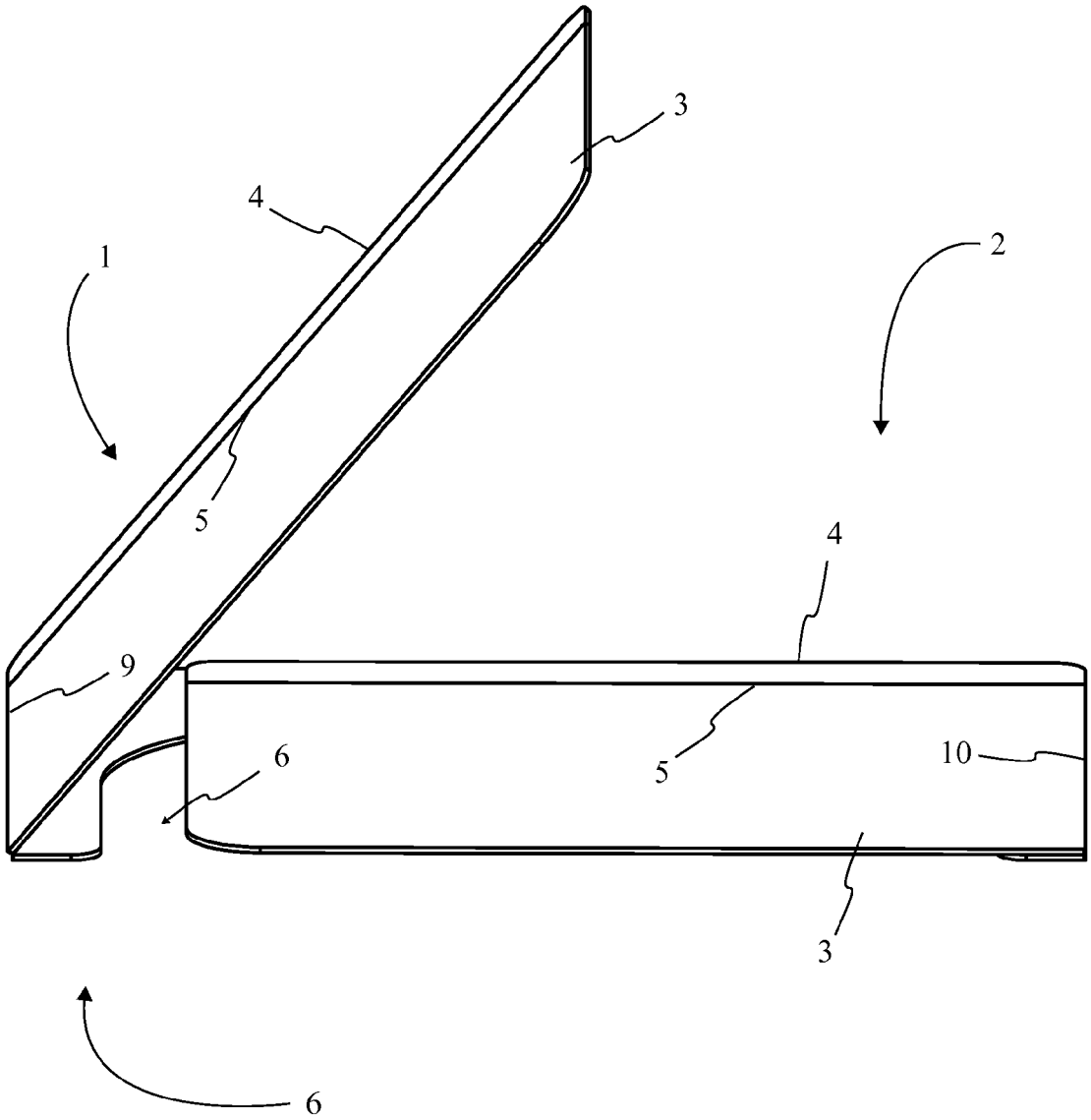
FIG. 3 is a top down elevational view of the partially collapsed state of the apparatus displaying the orientation of the first and second panel relative to the central section as per the current embodiment of the present invention.
Figure 4:
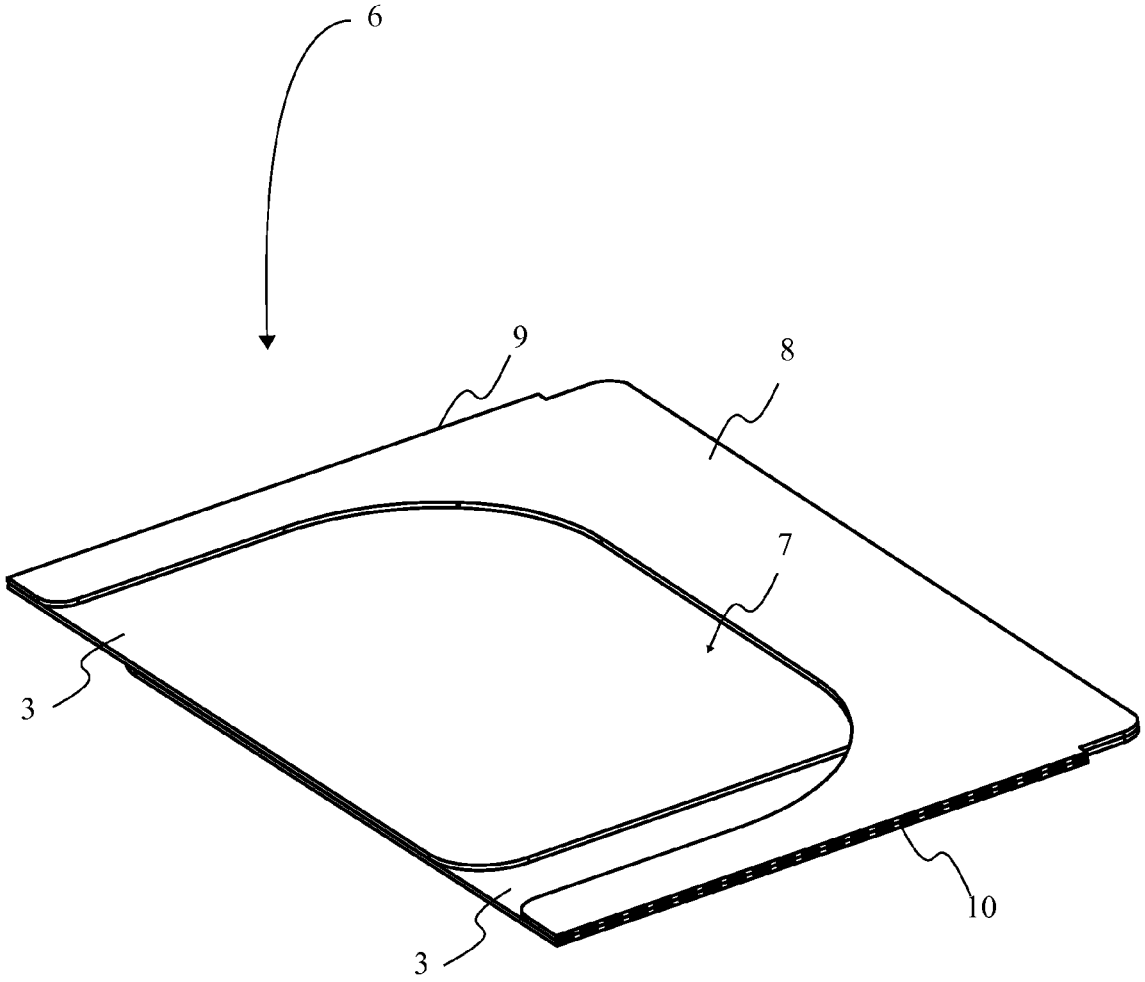
FIG. 4 is a perspective view of the collapsed state of the apparatus displaying the positioning of the first panel, the second panel, and the central section as per the current embodiment of the present invention.

Referencing FIG. 3 and FIG. 4, the collapsible dual sided privacy carrel exists in a collapsed state for facilitated storage and a deployed state for reducing unwanted distraction. Both the collapsed state and the deployed state provide a particular positioning and orientation between the first panel 1, the second panel 2, and the central section 6. In the collapsed stated, the orientation of the first panel 1, the second panel 2, and the central section 6 are provided to reduce the size of the present invention in order to facilitate storage. In the collapsed state, the first panel 1 is pivoted about the first hinge 9 becoming parallel with the central section 6. The second panel 2 is pivoted about the second hinge 10 becoming parallel with the central section 6. The direction of rotation between the first panel 1 and the central section 6 is opposite to the direction of rotation between the second panel 2 and the central section 6. In this configuration the first panel 1 is found coincident with the second panel 2 while either the first panel 1 or the second panel 2 are found coincident with the central section 6.

Figure 5:
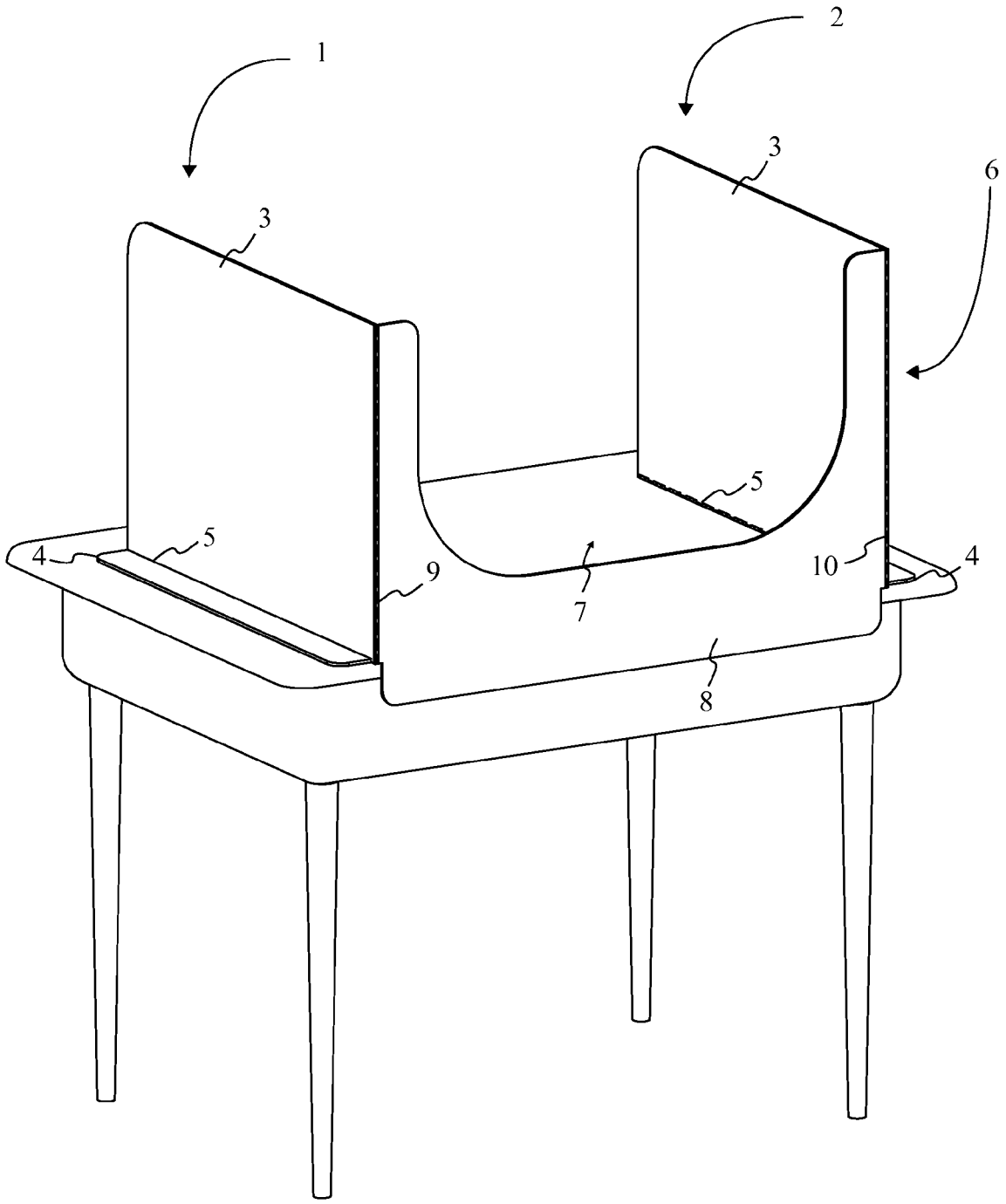
FIG. 5 is a frontal perspective view of the present invention in the first deployed configuration positioned atop a work surface.
Figure 6:
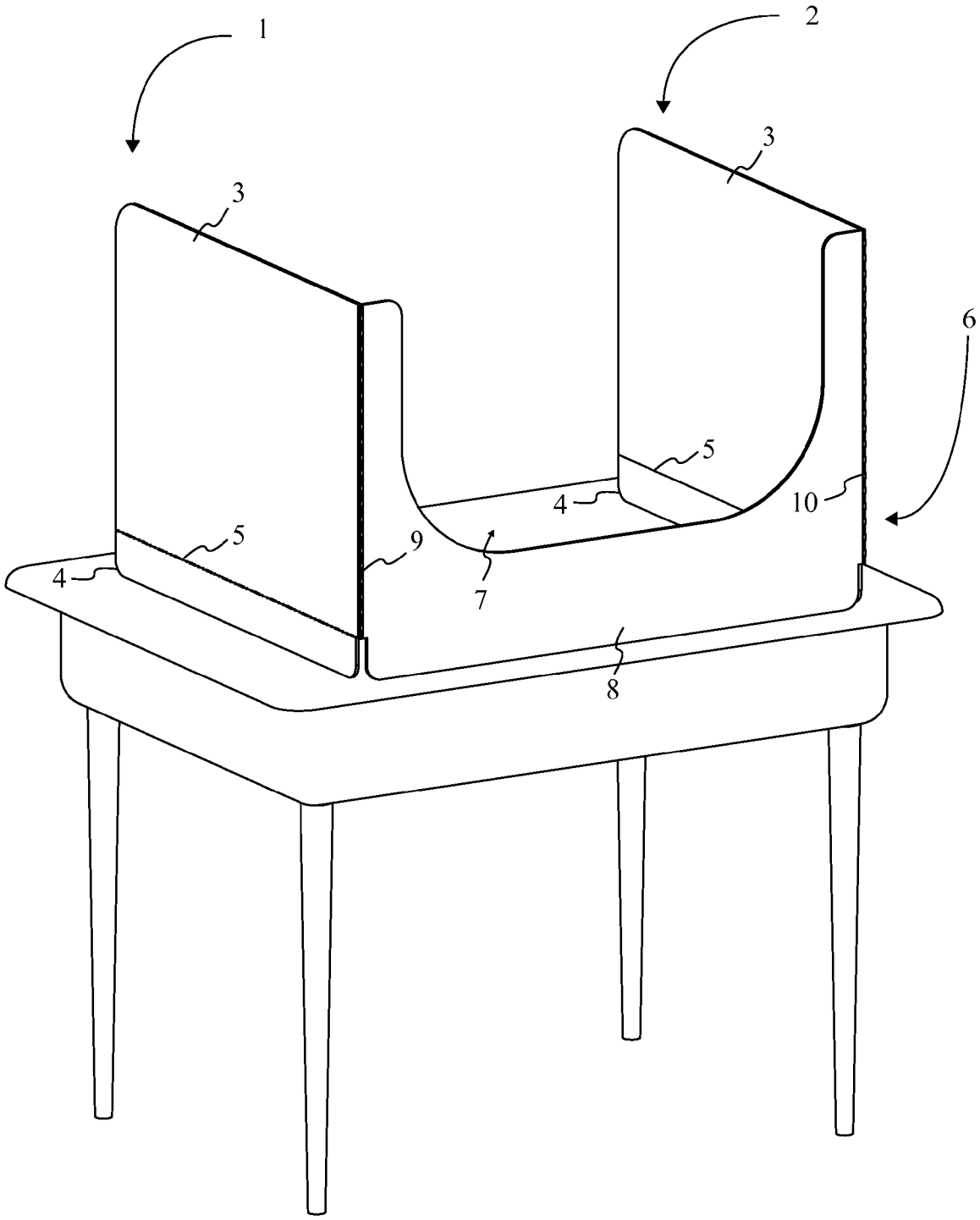
FIG. 6 is a frontal perspective view of the present invention in the second deployed configuration positioned atop a work surface.

Referencing FIG. 5 and FIG. 6, in the deployed state, the positioning of the first panel 1, the second panel 2, and the central section 6 are provided to securely mount the present invention atop a work surface. In the deployed state, the first panel 1 is found being parallel to the second panel 2. The first panel 1 is pivoted about the first hinge 9 becoming perpendicular to the central section 6. The second panel 2 is pivoted about the second hinge 10 becoming perpendicular to the central section 6. The direction of rotation between the first panel 1 and the central section 6 is opposite to the direction of rotation between the second panel 2 and the central section 6. Additionally, the deployed state comprises two configurations determined by the positioning of the ground contacting section 4 relative to the work surface, as well as the positioning of the support section 8 relative to the work surface. The first deployed configuration offers the present invention a wider base through the orientation of the ground contacting section 4 as well as a structural over hang through the positioning of the support section, for increased stability atop a work surface. In the first deployed configuration, the ground contacting section 4 is found perpendicular to the peripheral vision obstruction 3. The coordinate angle between the ground contacting section 4 and the peripheral vision obstruction 3 of the first panel 1 is opposite to the coordinate angle between the ground contacting section 4 and the peripheral vision obstruction 3 of the second panel 2. The support section 8 is found as a structural overhang that perpendicularly engages the edge of the work surface in order to securely hold the apparatus in place. The second deployed configuration offers the present invention with three narrow surfaces that engage a work surface. In the second deployed configuration the ground contacting section 4 is found coplanar to the peripheral vision obstruction 3. The ground contacting section 4 provides a pair of parallel positioned narrow contacting areas with the work surface. The support section 8 is found being perpendicular to the ground contacting sections 5 and engage the work surface as a structural base. Both the ground contacting section 4 and the support section 8 perpendicularly engage the work surface providing stability to the present invention in the second deployed configuration.

Referencing FIG. 2, in the current embodiment of the present invention the first hinge 9, the second hinge 10, and the section hinge 5 are provided as scoring lines that allow the associated sections to fold. While the current embodiment of the present invention does not utilize a separate physical component for the first hinge 9, the second hinge 10, and the section hinge 5, it should be understood that a physical pivoting hinge could potentially be utilized. The physical pivoting hinge can be provided in a manner that allows the first panel 1 to be coupled to the first hinge 9, the second panel 2 to be coupled to the second hinge 10, the central section 6 being coupled to both the first hinge 9 and the second hinge 10, and the peripheral vision obstruction 3 being coupled to the ground contacting section 4.

In the current embodiment of the present invention, the collapsible dual sided carrel is constructed of a single piece of corrugated cardboard. While the current embodiment utilizes a single piece of corrugated cardboard, it should be understood as an obvious difference for the present invention to be constructed utilizing a plurality of materials and material combinations as long as said materials and material combinations provide the same functionality currently afforded by the present invention in its current construction. Furthermore, it should be understood as an obvious difference to provide the present invention as several pieces that are coupled together to form the various components and subcomponents.

In the current embodiment of the present invention, the central section 6, the first panel 1, and the second panel 2 are rectangular in shape. While the current embodiment of the present invention utilizes rectangular geometry for the various sections it should be understood as an obvious difference to form the central section 6, the first panel 1, and the second panel 2, in any geometry that offers the same functionality currently exhibited by the present invention.

Although the invention has been explained in relation to its preferred embodiment, it is to be understood that many other possible modifications and variations can be made without departing from the spirit and scope of the invention as hereinafter claimed.

What is claimed is:

1. A storable dual sided privacy carrel for use improving work place productivity and classroom success comprises, a first panel;

a second panel;

a central section;

a first hinge;

a second hinge;

the first panel and the second panel each comprise a ground contacting section, a peripheral vision obstruction, and a section hinge;

the central section comprises a viewing area and a support section, the ground contacting section being pivotably attached to the peripheral vision obstruction by way of the section hinge;

the ground contacting section being perpendicularly positioned to the peripheral vision obstruction wherein, the ground contacting section runs parallel and coincident with a work surface and serves as a secure footing for the storable dual sided privacy carrel; and the support section being engaged as a structural overhang wherein, the support section over hangs the work surface in a manner which engages the surface edge providing structural support to the dual sided privacy.

2. The storable dual sided privacy carrel for use improving work place productivity and classroom success as claimed in claim 1 comprises, the central section being positioned between the first hinge and the second hinge;

the first hinge being positioned between the first panel and the central section; and the second hinge being positioned between the second section and the central section.

3. The storable dual sided privacy carrel for use improving work place productivity and classroom success as claimed in claim 1 comprises, the section hinge being positioned between the peripheral vision obstruction and the ground contacting section;

the viewing area being positioned above the support section; and the viewing area being laterally bordered by the peripheral vision obstruction of the first panel and the peripheral vision obstruction of the second panel.

4. The storable dual sided privacy carrel for use improving work place productivity and classroom success as claimed in claim 1 comprises, the first panel being pivotably attached to the central section by way of the first hinge; and the second panel being pivotably attached to the central section by way of the second hinge.

5. A storable dual sided privacy carrel for use improving work place productivity and classroom success comprises, a first panel;

a second panel;

a central section;

a first hinge;

a second hinge;

the first panel and the second panel each comprise a ground contacting section, a peripheral vision obstruction, and a section hinge;

the central section comprises a viewing area and a support section;

the ground contacting section being pivotably attached to the peripheral vision obstruction by way of the section hinge;

the ground contacting section being positioned coplanar to the peripheral vision obstruction wherein, the positioning of the ground contacting section provides a narrow contact area with a work surface; and the support section being engaged as a structural base wherein the positioning of the support section contacts provides a narrow contact area with the work surface.

6. The storable dual sided privacy carrel for use improving work place productivity and classroom success as claimed in claim 5 comprises, the section hinge being positioned between the peripheral vision obstruction and the ground contacting section;

the viewing area being positioned above the support section; and the viewing area being laterally bordered by the peripheral vision obstruction of the first panel and the peripheral vision obstruction of the second panel.

7. The storable dual sided privacy carrel for use improving work place productivity and classroom success as claimed in claim 5 comprises, the first panel being pivotably attached to the central section by way of the first hinge; and the second panel being pivotably attached to the central section by way of the second hinge.

8. The storable dual sided privacy carrel for use improving work place productivity and classroom success as claimed in claim 5 comprises, the central section being positioned between the first hinge and the second hinge;

the first hinge being positioned between the first panel and the central section; and the second hinge being positioned between the second section and the central section.

* * * * *